US006608606B1

(12) United States Patent
Chang

(10) Patent No.: US 6,608,606 B1
(45) Date of Patent: Aug. 19, 2003

(54) ANTENNA FOR MOBILE COMMUNICATION TERMINAL

(76) Inventor: Eung-Soon Chang, 103-904 Samik Ceramic Apt., 1038, Mansoo-dong, Namdong-gu, Inchon-shi (KR)

( * ) Notice: Subject to any disclaimer, the term of this patent is extended or adjusted under 35 U.S.C. 154(b) by 23 days.

(21) Appl. No.: 10/070,925

(22) PCT Filed: Sep. 25, 2000

(86) PCT No.: PCT/KR00/01057

§ 371 (c)(1),
(2), (4) Date: Mar. 11, 2002

(87) PCT Pub. No.: WO01/47058

PCT Pub. Date: Jun. 28, 2001

(30) Foreign Application Priority Data

Dec. 20, 1999 (KR) ..... 1999-59400

(51) Int. Cl.[7] ..... H01Q 1/24
(52) U.S. Cl. ..... 343/900; 343/702
(58) Field of Search ..... 343/900, 702, 343/901, 895, 906

(56) References Cited

U.S. PATENT DOCUMENTS 5,969,694 A * 10/1999 Harada et al. ..... 343/901
5,995,064 A * 11/1999 Yanagisawa et al. ..... 343/895
6,359,592 B1 * 3/2002 Chen et al. ..... 343/702
6,515,637 B1 * 2/2003 Chang ..... 343/895

FOREIGN PATENT DOCUMENTS

| | | |
|---|---|---|
| KR | 91-009154 U | 6/1991 |
| KR | 96-038769 U | 12/1996 |
| KR | 97-056107 U | 10/1997 |
| KR | 98-055846 U | 10/1998 |

* cited by examiner

*Primary Examiner*—James Clinger
(74) *Attorney, Agent, or Firm*—R. Neil Sudol; Henry D. Coleman; William J. Sapone

(57) ABSTRACT

An antenna for a mobile communication terminal in which part of an antenna rod is slidably mounted into an assist antenna rod such that the antenna may be selectively extended in one or two stages. A connecting portion between the antenna rod and the assist antenna rod is rolled so that the antenna rod is prevented from being easily escaped from the assist antenna rod when the antenna is extended in two-stage. Thus, an enhanced communication quality may be obtained by extending the antenna length even when the mobile communication device is slimmed and an optimized length of the antenna is not secured.

3 Claims, 3 Drawing Sheets

ANTENNA FOR MOBILE COMMUNICATION TERMINAL

TECHNICAL FIELD

The present invention relates to an antenna, and more particularly, to an antenna for a mobile communication terminal which can be extended by users, selectively, in two stage so as to obtain an enhanced reception sensitivity of a mobile communication terminal and is configured to be less damaged by a frequent extension thereof.

BACKGROUND ART

In general, an antenna functions as a receiver for receiving a radio frequency from an exterior and as a transmitter for transmitting a signal from other internal apparatuses to an exterior. Most radio communications system adopts antennas.

Such an antenna is simple in configuration, and a study on physical characteristics of antennas and an optimized antenna length is in progress so that an exterior noise generated from other devices may be eliminated and an environment with obstacles, for example, buildings, may be overcome.

Specifically, functions of the antenna significantly increase when mounted to a mobile communication terminal. This is to effectively receive the transmitted radio frequency and provide an excellent communication quality to users.

Conventional antennas mounted to a mobile communication terminal are structured to allow users to extend an antenna knob from an interior of the mobile communication terminal.

However, length of the mobile communication terminal is tending to decrease, thus decreasing the antenna length. Thus-decreased length of antenna deteriorates communication quality, therefore, mobile communication terminal manufacturers overcome such problems by adding circuits for controlling the lowered communication quality.

However, it is more desirable to receive an excellent signal and amplify the same than to delete a noise in the received signal. Therefore, a method of elongating the antenna length regardless of the size of the mobile communication terminal, is required.

SUMMARY OF THE INVENTION

Therefore, it is an object of the present invention to provide an antenna which can be extended regardless of the size of mobile communication terminal.

To accomplish the above object of the present invention, there is provided an antenna for a mobile communication terminal including: a hollow support rod mounted in a mobile communication terminal; an antenna rod slidably mounted in the hollow rod; an assist antenna rod slidably mounted into a portion of the antenna rod; and an antenna fixing unit for defining movement range of the antenna rod and fixing the same, in which a portion of an end of the assist antenna rod is rolled toward an inner space thereof.

BRIEF DESCRIPTION OF DRAWINGS

The present invention will become more fully understood from the detailed description given hereinafter accompanying drawings, which are given by way of illustration only, and thus are not limitative of the present invention, and wherein.

BEST MODE FOR CARRYING OUT THE INVENTION

An antenna according to preferred embodiments of the present invention will now be explained in more detail with reference to the attached drawings.

Figure 1:
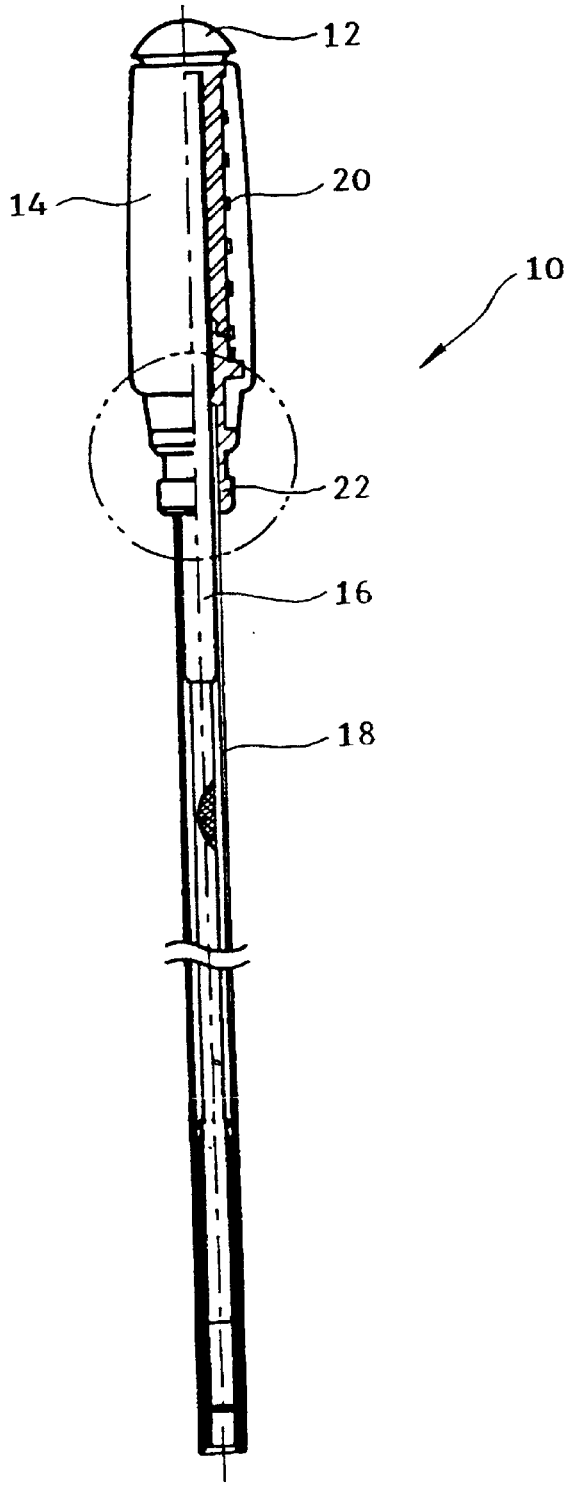
FIG. 1 is a side view partially showing an antenna for a mobile communication terminal according to the present invention.

FIG. 1 is a side view partially showing an antenna for a mobile communication terminal according to the present invention, wherein an antenna 10 includes an antenna knob 12 for extending an antenna rod 16, an antenna fixing unit 14 for defining the movement range of the antenna 10 and fixing the same, and a support rod 18 installed inside of the mobile communication terminal so as to provide a space for movement of the antenna. In addition, a metal for receiving a radio wave is prepared under the antenna 10.

Here, outer covers of the antenna knob 12 and antenna fixing unit 14 are made up of one selected from synthetic resins such as a polyurethane or nylon 66. A spring 20 is prepared inside of the antenna fixing unit 14, and the external diameter of the lower portion 22 of the antenna fixing unit 14 is shaped as a screw so that it can be coupled to the screw portion prepared in the upper portion of the antenna of the mobile communication terminal.

Figure 2:
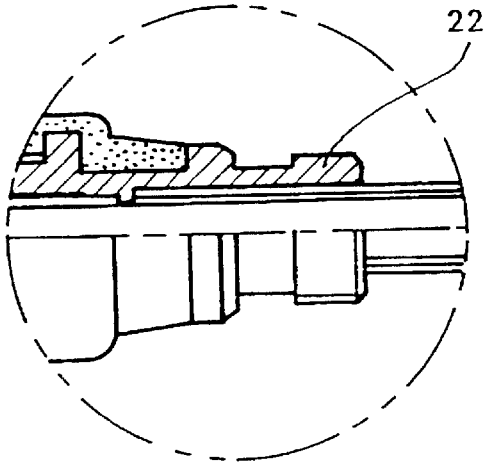
FIG. 2 is an enlarged side view showing the portion A of FIG. 1.

As shown in FIG. 2 in which portion A of FIG. 1 is enlarged, the antenna rod 16 has an upper portion which has a diameter larger than that of the lower portion thereof, such that the antenna rod 16 may have a strength not to be damaged by a frequent extension/retraction thereof.

Two-stage extending/retracting of the antenna rod, as characterized in the present invention, will be explained in more detail with reference to embodiments 1 and 2

Embodiment 1

An antenna according to embodiment 1 of the present invention is configured in that a lower end of the antenna rod is inserted into the assist antenna rod, and an end of the assist antenna rod is rolled toward the inner space thereof, thereby preventing the antenna rod from being easily escaped from the assist antenna rod.

Figure 3:
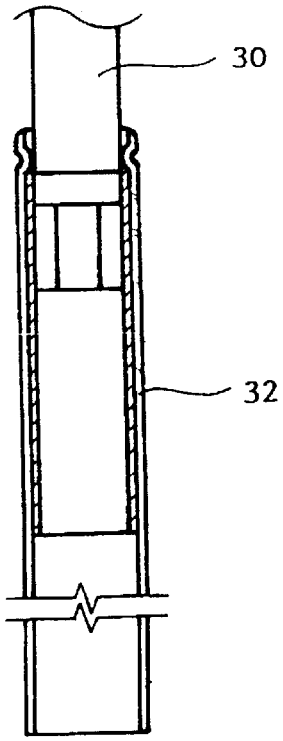
FIG. 3 is a section view showing an antenna for a mobile communication terminal according to embodiment 1 of the present invention.

FIG. 3 is a section view showing an antenna for a mobile communication terminal according to embodiment 1 of the present invention, in which hexagonal punching is performed partially in a lower portion of an antenna rod 30 so that the antenna rod 30 may not be escaped from a first assist antenna rod 32.

The upper circumference of the first assist antenna 32 is partially rolled toward the inner diameter so that the antenna rod 30 may not be easily escaped from the first assist antenna 32. Moreover, the antenna rod 30 may not be easily retracted even when the antenna rod 30 has not been completely extended.

Here, the diameter of the rolled portion of the first assist antenna 32 is 1.4 mm to 1.5 mm, and preferably 1.45 mm.

Embodiment is characterized in that the upper circumference of the first assist antenna 32 is rolled toward the inner diameter. Such a characteristic of embodiment 1 can be accomplished by a common method of using a press molding method, however, such an accomplishment is not intended to be limited to the press molding method.

Embodiment 2

In embodiment 2, the lower end of the antenna rod is inserted into the assist antenna rod, provided that part of the assist antenna rod is rolled toward the inner diameter thereof, thus preventing the antenna rod from being easily escaped from the assist antenna rod.

Figure 4:
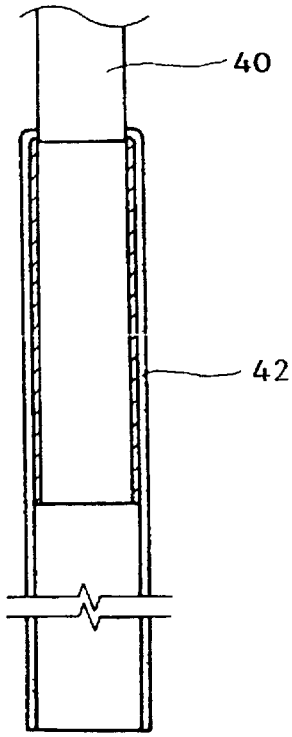
FIG. 4 is a section view showing an antenna of mobile communication terminal according to embodiment 2 of the present invention.

FIG. 4 is a section view showing an antenna for a mobile communication terminal according to embodiment 2 of the present invention, wherein part of lower portion of the antenna rod 40 is slidably mounted in a second assist antenna rod 42.

If such is a case, the second assist antenna rod 42 may hold the antenna rod 40 less tightly than those of embodiment 2. Therefore, the difference between the outer radius of the antenna rod 40 and the inner diameter of the second assist antenna rod 42 is minimized, thus allowing a tightness therebetween. In addition, it is desirable that an end of the second assist antenna rod 42 is made smooth, thereby preventing the outer radius of the antenna rod 40 from being scratched.

In the above-described embodiments 1 and 2, the assist antenna rod is adapted to allow two-stage extension of the antenna. Thus, users may extend the antenna up to stage 1 in an area where a radio wave reception is well performed, say, in the city, and up to stage 2 where a radio wave reception may not be easily performed.

Such a 2-stage extension is made possible due to a keeper shown in the hatched portions of FIGS. 3 and 4, which will be explained in detail as follows.

Figure 5:
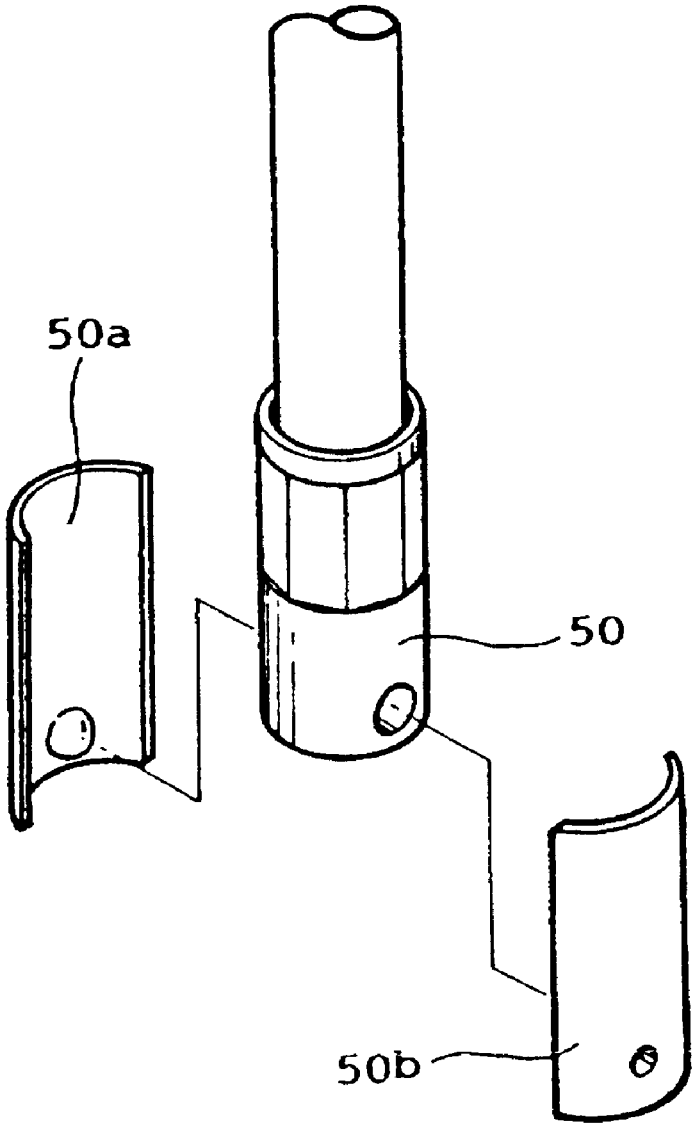
FIG. 5 is a perspective view illustrating a configuration of a keeper of the antenna according to the present invention.

As shown in FIG. 5, two protrusions of keepers 50*a* and 50*b* are to be inserted into two holes penetrating through an end of an antenna rod 50. The keepers 50*a* and 50*b* are first formed as a cylinder, but shown as a split one for an explanation convenience. Here, it is desirable that two keepers 50*a* and 50*b* function minutely such that they may provide users with feelings of passing from stage 1 to stage 2.

The main idea of the present invention, explained through embodiments 1 and 2, is to provide an antenna for a mobile communication terminal in which an assist antenna rod for 2-stage extension/retraction is slidably mounted in an antenna rod, so that the antenna for the mobile communication terminal may be extended maximum and not be easily damaged by a frequent extension/retraction of the antenna rod and assist antenna rod.

As described above, the present invention has benefits as follows.

First, communication quality is enhanced by ensuring an optimized length of antenna even when the antenna of the mobile communication terminal is slim-sized.

Second, an antenna may be extended long so that communication quality is enhanced.

Third, an antenna rod may not be easily escaped even when the assist antenna rod is frequently extended or retracted.

Fourth, 2-stage system of the antenna allows user convenience, such that he/she may extend only stage 1 in an area where a radio wave reception is well performed.

The various modifications to the embodiments will be readily apparent to those skilled in the art, and the generic principles defined herein may be applied to other embodiments without the use of the inventive faculty. Thus, the present invention is not intended to be limited to the embodiments shown herein but is to be accorded the widest scope consistent with the principles and novel features disclosed herein.

What is claimed is:

1. An antenna for a mobile communication terminal comprising a hollow support rod mounted in a mobile communication terminal, an antenna rod slidably mounted in the hollow rod, an assist antenna rod slidably mounted into a portion of the antenna rod, and an antenna fixing unit for defining movement range of the antenna rod and fixing the same, said antenna further comprising:

a keeper arranged at an outer surface of said antenna rod which is to be secured to said assist antenna rod for catching the antenna when extended in two-stage; and said assist antenna rod which is connected to said antenna rod has an inner circumference part of which is rolled toward the inner space of said assist antenna rod such that said antenna rod may not be escaped from said assist antenna rod.

2. An antenna for a mobile communication terminal according to claim 1, wherein said assist antenna rod has an end inner circumference of which is rolled toward the inner space of said assist antenna rod.

3. An antenna for a mobile communication terminal according to claim 1, wherein said protrusion of part of said inner circumference of said assist antenna rod has a diameter of 1.4 mm to 1.5 mm.

* * * * *